United States Patent [19]

Georges

[11] 4,162,070

[45] Jul. 24, 1979

[54] DEVICE FOR TENNIS INSTRUCTION

[76] Inventor: Barbara Georges, 1109 College View Dr., Monterey Park, Calif. 91754

[21] Appl. No.: 891,906

[22] Filed: Mar. 30, 1978

[51] Int. Cl.[2] ..... A63B 61/00

[52] U.S. Cl. ..... 273/29 A

[58] Field of Search ..... 273/29 R, 29 A, 26 R, 273/1.5 R, 1.5 A, 26 E

[56] References Cited

U.S. PATENT DOCUMENTS

| | | | |
|---|---|---|---|
| 3,166,316 | 1/1965 | O'Leary | 273/29 R |
| 3,893,669 | 7/1975 | Myers | 273/29 A |
| 3,994,494 | 11/1976 | Kelley | 273/26 E |

FOREIGN PATENT DOCUMENTS

| | | | |
|---|---|---|---|
| 434143 | 8/1935 | United Kingdom | 273/26 E |

*Primary Examiner*—Richard C. Pinkham
*Assistant Examiner*—T. Brown

[57] ABSTRACT

A device for aiding in tennis instruction which primarily comprises a base having a post of telescoping members attached thereto and extending upwards therefrom. An arm is pivotally attached intermediate its ends to the upper end of the post. One of the ends of the arm is provided with a loop or eye which serves as a target for receiving an upwardly tossed ball. Attached intermediate the ends of the post are a pair of horizontally extending vertically spaced arms, one of the arms rotatably supporting a pulley and the other arm rotatably supporting a motor operated reel. One end of a line is attached to the other end of the pivotally attached arm, an intermediate portion of the line is secured to the pulley and the other end of the line is secured to the motor driven reel. A foot-activated switch is electrically attached to the motor of the reel whereby a player can activate the motor to raise and lower the one end of the arm having the loop or eye.

6 Claims, 3 Drawing Figures

FIG. 1
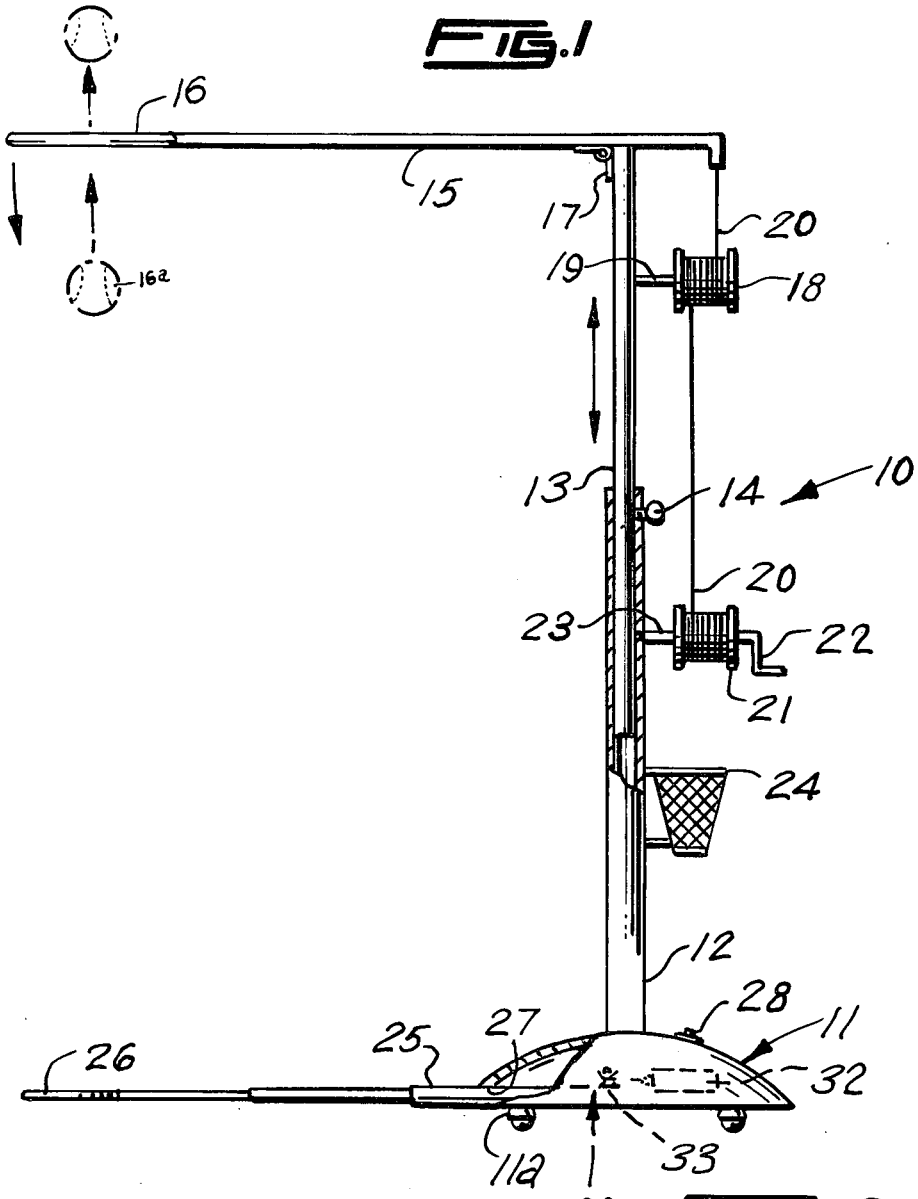
FIG. 2
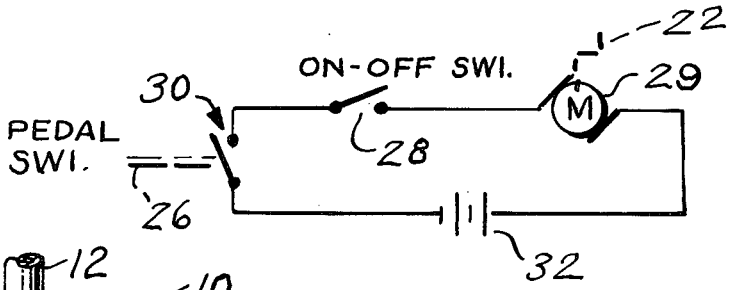
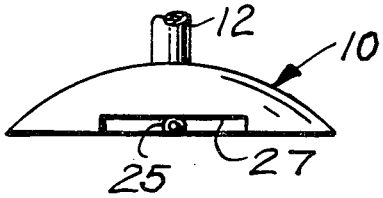
FIG. 3

DEVICE FOR TENNIS INSTRUCTION

This invention relates to targets, and more particularly, to a device for tennis instruction.

The principal object of this invention is to provide a device for tennis instruction, which will enable a player to develop the tennis service skill.

Another object of this invention is to provide a device for tennis instruction, which is designed to teach the basic fundamentals of the serve, correct weaknesses, and enhance the learning of the practical application of the serving stroke.

A further object of this invention is to provide a device for tennis instruction, which will have a target carried thereon for practice purposes.

Other objects of the invention are to provide a device for tennis instruction, which will be simple in design, inexpensive to manufacture, easy to use, and efficient in operation.

These, and other objects of the invention will become readily evident, upon a study of the accompanying drawing wherein:

FIG. 1 is a side view of the present invention, shown in elevation and partly broken away;

FIG. 2 is a schematic wiring diagram of the invention, and

FIG. 3 is a fragmentary front view of FIG. 1 shown in elevation.

According to this invention, device 10 is shown to include a circular base 11, having rollers 11*a*. An elongated sleeve 12 is fixedly secured to base 11, and a tube 13 is telescopingly received in sleeve 12 and is adjustable in height by means of set screw 14. A pivotable arm 15 having an eye 16 on its end, is secured to tube 13 by means of a hinge 17. A pulley 18 is secured on arm 19, which is fixedly secured to tube 13. A line 20 is secured at one end on a reel 21, and is secured at its other end to one end of arm 15; an intermediate portion of the line 20 being wrapped around the pulley 18, as is clearly shown in FIG. 1 of the drawing. Reel 21 is provided with a crank handle 22 and reel 21 is secured on arm 23, which is fixedly secured to sleeve 12. A basket 24, which is optional, is secured to sleeve 12 for receiving tennis balls for use with device 10.

A telescoping arm 25 includes a foot pedal 26 on one end, and arm 25 is pivotable within slot 27 of base 11. An on-off switch 28 is in series with motor 29, pedal switch 30, and battery 32 for the operation of device 10. When the player moves the foot pedal 26, the arm 15 raises to a horizontal position. When player's foot is removed, the arm 15 moves to a stationary, vertical position. The player tosses tennis ball 16*a* into eye 16 as shown in FIG. 1, and then strikes it.

It shall be noted that motor 29 is a part of the reel 21 structure for the movement of line 20, for the operation of arm 15.

While various changes may be made in the detail construction, it is understood that such changes will be within the spirit and scope of the present invention as is defined by the appended claims.

What I now claim is:

1. A device for tennis instruction, comprising in combination, a hollow base, a vertically upward sleeve secured on said base, a tube slidably received in said sleeve, an upper portion of said tube extending outwardly of an upper end of said sleeve, a set screw threaded in a side of said sleeve bearing at its end against a side of said tube for selective securement together, a first arm having a hinge along a longitudinally intermediate portion thereof, said hinge being secured to an upper end of said tube, one end of said first arm having an eye into which a tennis ball is tossed by a player, and a mechanism connected to an opposite end of said first arm for pivoting said arm about said hinge.

2. The combination as set forth in claim 1, wherein said mechanism comprises a sideward extending second arm, which is stationarily secured on said sleeve, said second arm supporting a reel, a line wound around said reel, one end of said line secured to said reel, and an opposite end of said line being secured to said opposite end of said first arm.

3. The combination as set forth in claim 2, wherein said mechanism includes a sidewardly extending third arm which is stationarily secured on said tube, a freely rotatable pulley on said third arm, and an intermediate portion of said line being wrapped around said pulley.

4. The combination as set forth in claim 3, wherein a foot pedal is on an outer end of a telescoping fourth arm that protrudes outwardly of said base, said fourth arm being movable by said foot pedal, in a slot of said base, and an electric circuit activated by movement of said fourth arm for rotating said reel.

5. The combination as set forth in claim 4, wherein said electric circuit comprises a switch in said base activated by said fourth arm movement, said switch being in series with a manually operated on-off switch mounted on said base, a battery stored inside said base, and a motor inside said reel.

6. The combination as set forth in claim 5, wherein said eye has a central opening along a vertical axis, so that said tennis ball travels vertically therethrough.

* * * * *